United States Patent [19]

Schulz

[11] Patent Number: 4,760,266

[45] Date of Patent: Jul. 26, 1988

[54] DEVICE FOR THE GENERATION OF THERMAL NEUTRONS

[75] Inventor: Wolfgang Schulz, Wunstorf, Fed. Rep. of Germany

[73] Assignee: Brown, Boveri Reaktor GmbH, Mannheim, Fed. Rep. of Germany

[21] Appl. No.: 912,931

[22] Filed: Sep. 26, 1986

[30] Foreign Application Priority Data

Sep. 28, 1985 [DE] Fed. Rep. of Germany ..... 3534760

[51] Int. Cl.[4] ..... G21G 4/02

[52] U.S. Cl. ..... 250/493.1; 250/390; 250/505.1

[58] Field of Search ..... 250/390 I, 390 R, 493.1, 250/503.1, 505.1, 515.1, 518.1; 376/350, 351, 220, 221

[56] References Cited

U.S. PATENT DOCUMENTS

| | | | |
|---|---|---|---|
| 3,659,106 | 4/1972 | Cason | 250/506.1 |
| 3,914,612 | 10/1975 | Cason, Jr. et al. | 376/114 |
| 4,300,054 | 11/1981 | Dance et al. | 250/390 I |
| 4,324,979 | 4/1982 | Bewley et al. | 250/505.1 |
| 4,464,330 | 8/1984 | Speir et al. | 250/390 R |
| 4,582,999 | 4/1986 | Dance et al. | 250/505.1 |

FOREIGN PATENT DOCUMENTS

| | | | |
|---|---|---|---|
| 3031107 | 9/1982 | Fed. Rep. of Germany . | |
| 0706503 | 3/1954 | United Kingdom | 250/390 I |

*Primary Examiner*—Janice A. Howell
*Assistant Examiner*—William F. Rauchholz
*Attorney, Agent, or Firm*—Herbert L. Lerner; Laurence A. Greenberg

[57] ABSTRACT

A device for the generation of thermal neutrons includes a gas-filled housing having a wall with inner surfaces and a neutron outlet opening, a spherical moderator housing disposed in the gas-filled housing, a transportable neutron source disposed in the spherical moderator housing, and cups formed of moderating material disposed between the moderator housing and the inner surface of the wall of the gas-filled housing, the cups being spaced at a given distance from the inner surface of the wall of the housing, from the moderator housing and from each other defining spaces between the cups, and the spaces between the cups defining openings directed toward the neutron outlet opening.

10 Claims, 3 Drawing Sheets

DEVICE FOR THE GENERATION OF THERMAL NEUTRONS

The invention relates to a device for the generation of thermal neutrons, including a housing containing a transportable neutron source and a moderator and having a neutron outlet opening.

German Patent No. DE-PS 30 31 107 describes such a device. Normally, cost-intensive basic materials are needed for the production of neutron sources. Therefore, the need to improve the ratio of the source size to the number of thermal neutrons exiting the source housing has existed for a long time. However, the solutions to this problem suggested thus far by specialists continue to be unsatisfactory.

It is accordingly an object of the invention to provide a device for the generation of thermal neutrons, which overcomes the hereinafore-mentioned disadvantages of the heretofore-known devices of this general type and which improves the ratio of the source capacity to the thermal neutrons produced With the foregoing and other objects in view, there is provided, in accordance with the invention, a device for the generation of thermal neutrons, comprising a gas-filled housing having a wall with inner surfaces and a neutron outlet opening, a spherical moderator housing disposed in the gas-filled housing, a transportable neutron source disposed in the spherical moderator housing, and cups formed of moderating material disposed between the moderator housing and the inner surface of the wall of the gas-filled housing, the cups being spaced at a given distance from the inner surface of the wall of the housing, from the moderator housing and from each other defining spaces between the cups, and the spaces between the cups defining openings directed toward the neutron outlet opening.

The moderator cups serve both for the reflection of the neutrons primarily thermalized in the moderator housing and for the secondary moderation of a not inconsequential number of higher energy neutrons ($E > E_{therm}$) exiting the moderator housing.

In accordance with another feature of the invention, the cups are coaxial to the moderator housing. This improves the reflection characteristic.

In accordance with an added feature of the invention, the housing wall is in the form of another outer cup having free ends forming the neutron outlet opening. This improves the effect of the secondary moderation.

In accordance with an additional feature of the invention, there is provided neutron-permeable material enclosing the moderating material. This is done if a liquid is used as moderator.

In accordance with a further feature of the invention, there are provided brackets fastened to the cups and extended between the moderator housing and the inner surface of the wall of the gas-filled housing. This maintains the specified spacings between the cups.

In order to form a neutron holder, in accordance with yet another feature of the invention, the spherical moderator housing or ball has a step-shaped canal formed in the center thereof defining at least one shoulder and ending at opposite sides of the gas-filled housing, the neutron source being supported on the at least one shoulder. Due to the fact that the canal passes through from one side of the housing to the other, on one hand it is easy to introduce the neutron source into the moderator sphere or to remove it therefrom and on the other hand, if the housing is disposed in a water seal of purifier, there is assurance that water will flow through the canal.

In accordance with yet a further feature of the invention, the moderator housing has a center, the neutron outlet opening is disposed in a given plane and the cups are in the form of half shells having circular, ring-shaped openings in a plane running parallel to the given plane of the neutron outlet opening and intersecting the center of the moderator housing. The neutrons secondarily moderated or reflected in the vicinity of the cups thus reach the neutron outlet opening along the shortest path.

In accordance with a concomitant feature of the invention, the gas-filled housing includes a cylindrical part, and including a collimator with a collimator inlet side and at least one collimation path, the collimator inlet side having a plastic or synthetic plating, coating or lining disposed thereon defining a free, open collimation path, and a plastic or synthetic plating, coating or lining disposed on the cylindrical part of the housing extending in a continuous taper to the collimator inlet side and forming part of the plating on the collimator inlet side. It is therefore seen that it is possible to use the device in combination with a collimator. With this embodiment, the higher energy neutrons still flowing in the direction toward the neutron outlet opening after their primary moderation, are also moderated secondarily, thus contributing to a further improvement of the efficiency of the neutron source.

Other features which are considered as characteristic for the invention are set forth in the appended claims.

Although the invention is illustrated and described herein as embodied in device for the generation of thermal neutrons, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
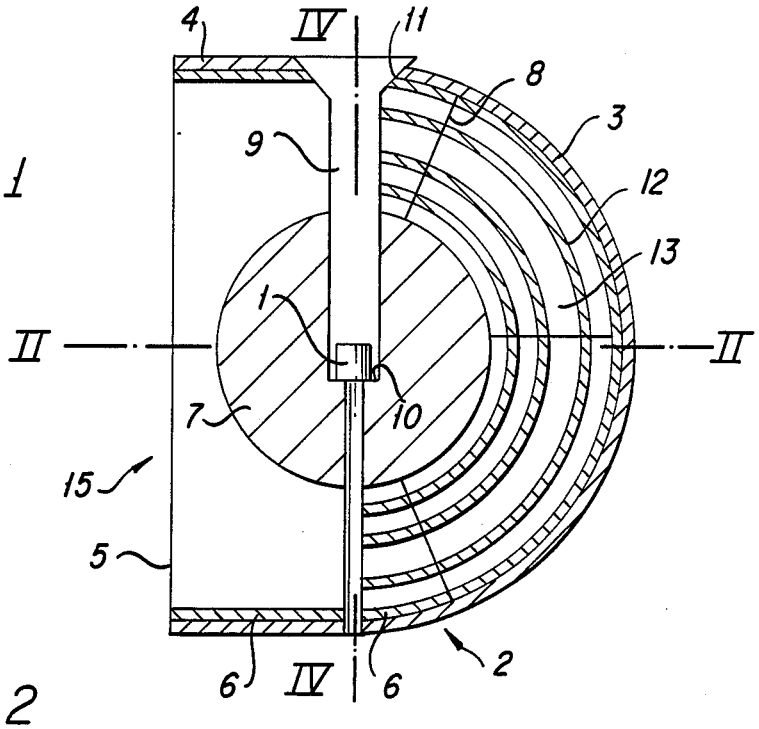
FIG. 1 is a diagrammatic cross-sectional view of the device according to the invention.
Figure 2:
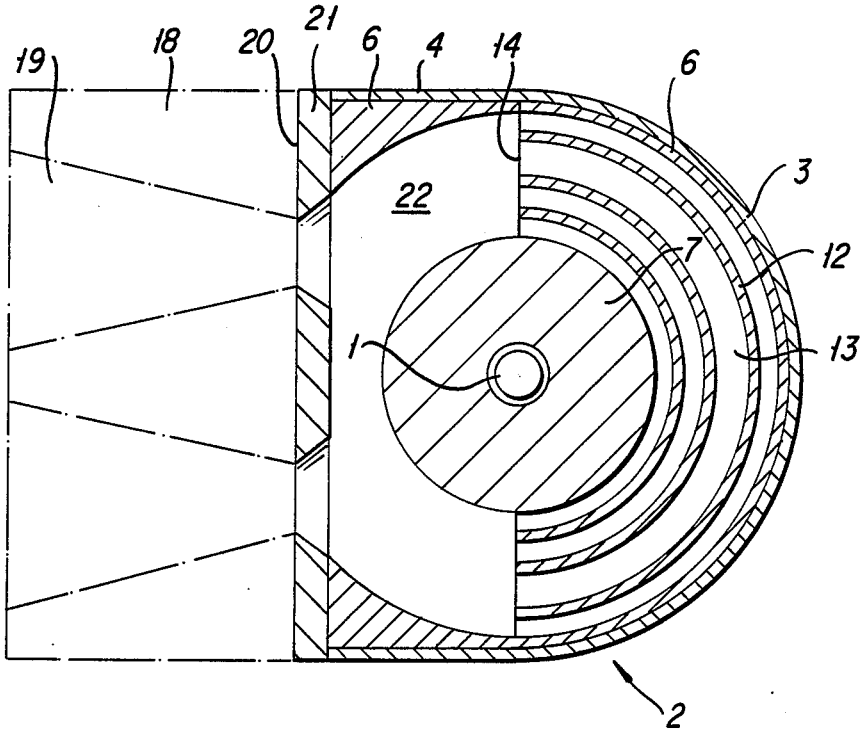
FIG. 2 is a cross-sectional view taken along the line II—II of FIG. 1.

Referring now to the figures of the drawings in detail and first, particularly, to FIGS. 1 and 2 thereof, there is seen a housing 2 which encloses a neutron source 1 and is formed of a hemispherically constructed shell 3 having free ends 4 that are extended in the form of a cylinder. A disc 5 formed of neutron-permeable material such as aluminum, extends perpendicular to the wall of the cylinder and bridges the free ends. The cylindrical and the hemispherical parts of the housing 2 are also formed of aluminum. The inner surface of the wall of the housing 2 is provided with a lining 6 of neutron-moderating material such as polyethylene. A moderator housing 7 is centrally disposed in the hemispherical part of the housing 2. The moderator housing 7 is spherical, is maintained in position by aluminum brackets 8 and contains a filling of moderating material. If plastic or synthetic material is used for the moderator, no moderator housing is needed. The moderator is then merely a plastic or synthetic ball.

A canal or channel 9, which is constructed as a stepped hole, penetrates the center of the moderator housing or ball 7 and extends from one side of housing 2 to the other, penetrating the wall thereof. The neutron source 1, which is supported by a shoulder 10 of the canal or stepped hole, is introduced from the end of the stepped hole having the larger diameter. In the vicinity of the housing wall, the stepped hole is constructed as a funnel 11 in order to facilitate the introduction of the neutron source 1.

Figure 4:
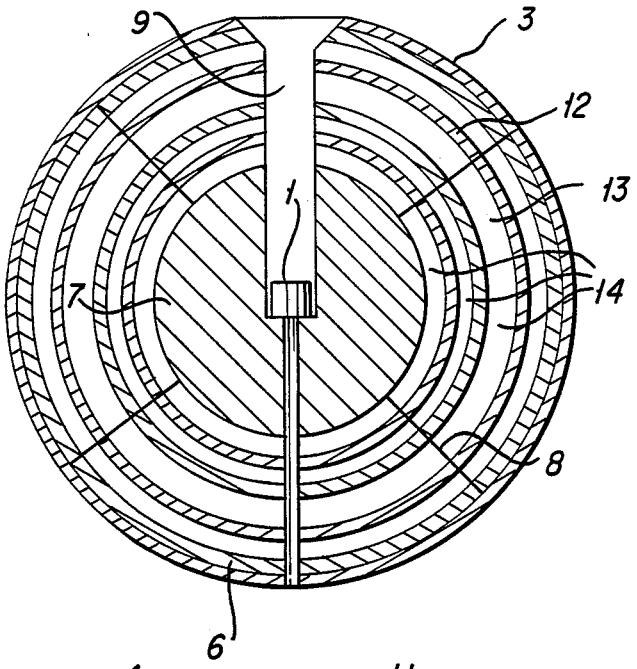
FIG. 4 is a cross-sectional view taken along the line IV—IV in FIG. 1.
Figure 5:
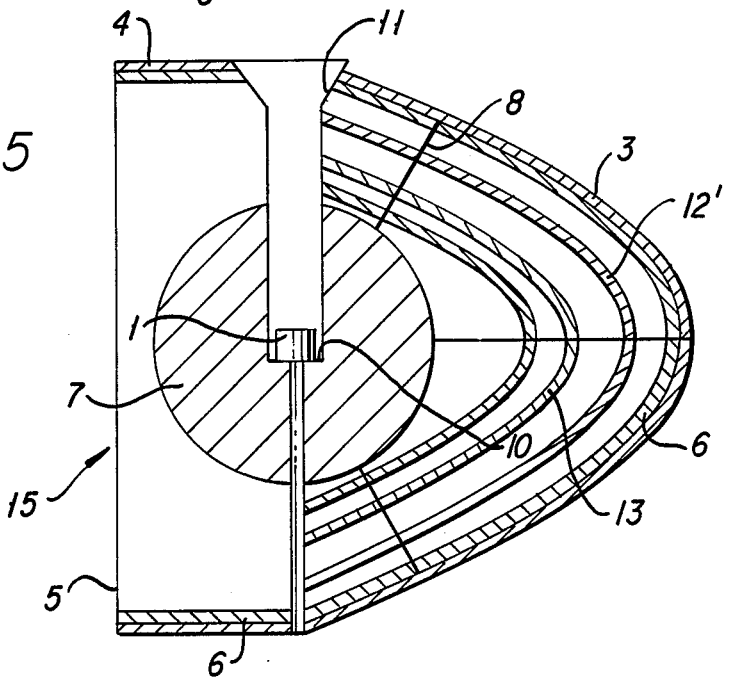
FIG. 5 is a view similar to FIG. 1 showing another embodiment of the invention.

Disposed between the moderator housing 7 and the inner surface of the wall of the housing 2 are several spherical half shells or cups 12 being shown in FIGS. 1, 2 and 4 or parabolic half shells or cups 12' being shown in FIG. 5 and being formed of moderating material, which maintain a distance from each other as well as from the inner surface of the wall of the housing 2 and from the moderator ball 7. This creates intermediate spaces 13 in which the neutrons are reflected by the surfaces of the cups 12. A secondary moderation of epithermal and fast neutrons takes place in the half shells. The neutrons experience their primary moderation in the moderator ball 7. The half shells 12 are fastened to the brackets 8 extending between the moderator housing 7 and the inner surface of the wall of the housing 2. This assures that the spacings, once selected, are maintained. Annular openings 14 of the half shells 12, which are best seen in FIG. 4, form a plane which runs through the center of the moderator housing 7 and parallel to the disc 5 of the cylindrical housing part 4. The disc 5 forms a neutron outlet opening 15 of the housing 2.

Figure 3:
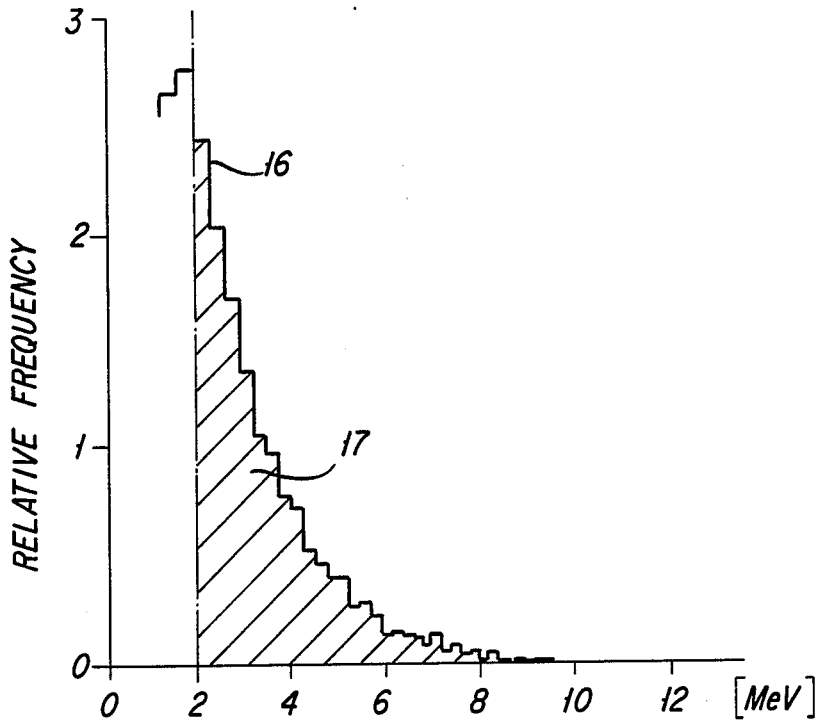
FIG. 3 is a graph of the neutron spectrum of a neutron source.

The operating mode of the device will now be explained by way of a neutron spectrum of a Californium-252 source with the aid of FIG. 3. The relative frequency H is plotted on the ordinate and the energy in MeV is plotted on the abscissa. As may be seen from the branch 16 of the curve, the mean neutron energy of this source approximates 2 MeV. The source configuration is such that the fraction of primary neutrons emitted by the source 1 and having the greatest relative frequency in the associated source spectrum of the source 1 corresponding to a mean neutron energy of 2 MeV (FIG. 3), is primarily slowed down to thermal energy ranges in the moderator ball 7. The shaded region 17 of the spectrum contains primary neutrons of higher energy ($E>2$ MeV) having thermalizations which proceed stepwise according to the half shells 12. For instance, the primary neutrons having energy intervals in the source spectrum only slightly above 2 MeV, are slowed down in the half shell adjacent the moderator housing 7. The neutrons of the next higher energy intervals are slowed down in the central half shells and those with an even higher energy are slowed down in the outer half shell. Primary neutrons of maximum energy experience their slowdown in the vicinity of the moderator lining 6 of the housing 2. In each interspace 13 furthermore the reflection of the thermal neutrons by the surfaces of the cups 12 and their dispersion in the direction toward the neutron outlet opening 15 of the housing 2 takes place. The reflection can be increased by enclosing the half shells 12 in an aluminum sheath if the housing 2 is disposed in a water seal. The number and thickness of the moderator half shells is determined in dependence on the respective source spectrum of the neutron source 1.

A further improvement of the thermal neutron yield is achieved in conjunction with a collimator 18 which is connected directly to the neutron outlet opening 15 and which has a collimator inlet side 20 with a plastic or synthetic plating 21 of predetermined or given thickness. This assures that the higher energy neutrons ($E>E_{therm}$) traveling from the moderator housing 7 in the direction of the neutron outlet opening 15, and hence not slowed down by the half shells, also experience a slowdown and reflection.

Beyond this, the plastic plating 21 of the collimator 18 reduces an absorption of thermal neutrons which, without such a plating, would take place due to the absorbing effect of the collimator material at the collimator side 20.

The lining 6 of housing 2 is extended to the collimation inlet side 20 in one continuous taper forming a part of the plating and thus additionally intensifying the secondary moderation and the reflection. Therefore, the plastic platings 21 and 6 are in effect an additional source of thermal neutrons.

A predetermined or given free space 22 in the region between the plane of the openings 14 of the moderator housing 7 and the plastic platings 21 and 6 is thus acted upon by a greatly increased thermal neutron flow. Converting the unoriented neutron flow in the free space 22 into an extracted or isolated, oriented neutron flow is accomplished in a known manner by means of the collimator. Collimators are required, for example, when objects are to be bombarded by an oriented neutron flow in order to determine their internal structure. The collimator 18 has two collimation paths 19 indicated in phantom lines in FIG. 2.

The foregoing is a description corresponding in substance to German Application No. P 35 34 760.0 dated Sept. 28, 1985, the International priority of which is being claimed for the instant application. Any material discrepancies between the foregoing specification and the aforementioned corresponding German application are to be resolved in favor of this latter.

I claim:

1. Device for the generation of thermal neutrons, comprising a gas-filled housing having a wall with inner surfaces and a neutron outlet opening, a spherical moderator housing disposed in said gas-filled housing, a transportable neutron source disposed in said spherical moderator housing, and cups formed of moderating material disposed between said moderator housing and said inner surface of said wall of said gas-filled housing, said cups being spaced at a given distance from said inner surface of said wall of said gas-filled housing, from said moderator housing and from each other defining spaces between said cups, and said spaces between said cups defining openings directed toward said neutron outlet opening.

2. Device according to claim 1, wherein said cups have axes passing through the center of said moderator housing.

3. Device according to claim 1, wherein said housing wall of said gas-filled housing is in the form of another outer cup having free ends forming said neutron outlet opening.

4. Device according to claim 1, including neutron-permeable material enclosing said moderating material.

5. Device according to claim 1, including brackets fastened to said cups and extended between said moderator housing and said inner surface of said wall of said gas-filled housing.

6. Device according to claim 1, wherein said moderator housing has a step-shaped canal formed in the center thereof defining at least one shoulder and ending at opposite sides of said gas-filled housing, said neutron source being supported on said at least one shoulder.

7. Device according to claim 1, wherein said moderator housing has a center, said neutron outlet opening is disposed in a given plane and said cups are in the form of half shells having circular, ring-shaped openings in a plane running parallel to said given plane of said neutron outlet opening and intersecting said center of said moderator housing.

8. Device according to claim 1, wherein said gas-filled housing includes a cylindrical part, and including a collimator with a collimator inlet side and at least one collimation path, said collimator inlet side having a plastic plating disposed thereon defining a free, open collimation path, and a plastic plating disposed on said cylindrical part of said gas-filled housing extending in a continuous taper to said collimator inlet side and forming part of said plating on said collimator inlet side.

9. Device according to claim 1, wherein said cups are spherical.

10. Device according to claim 1, wherein said cups are parabolic, said moderator housing has a center, said neutron outlet opening is disposed in a given plane and said cups are in the form of half shells having circular, ring-shaped openings in a plane running parallel to said given plane of said neutron outlet opening and intersecting said center of said moderator housing.

* * * * *